US008230622B2

(12) United States Patent
Dalla Torre et al.

(10) Patent No.: US 8,230,622 B2
(45) Date of Patent: Jul. 31, 2012

(54) SKI SLOPE SNOW TILLER

(75) Inventors: Andreas Dalla Torre, Freiendfeld (IT); Martin Runggaldier, St. Christina (IT)

(73) Assignee: Prinoth S.p.A., Vipiteno (IT)

( * ) Notice: Subject to any disclaimer, the term of this patent is extended or adjusted under 35 U.S.C. 154(b) by 194 days.

(21) Appl. No.: 12/532,293

(22) PCT Filed: Mar. 20, 2008

(86) PCT No.: PCT/IB2008/000688

§ 371 (c)(1),
(2), (4) Date: Mar. 18, 2010

(87) PCT Pub. No.: WO2008/114138

PCT Pub. Date: Sep. 25, 2008

(65) Prior Publication Data

US 2010/0186266 A1 Jul. 29, 2010

(30) Foreign Application Priority Data

Mar. 21, 2007 (IT) ..... MI2007A0565

(51) Int. Cl.
*E01H 4/00* (2006.01)

(52) U.S. Cl. ..... 37/219

(58) Field of Classification Search ..... 37/220–224, 37/260, 261, 269, 226, 196, 197, 258, 219; 172/72, 112, 117, 123, 310, 311, 197, 199, 172/200, 612, 684.5; 414/569; 404/90, 91
See application file for complete search history.

(56) References Cited

U.S. PATENT DOCUMENTS

| | | | | |
|---|---|---|---|---|
| 4,718,183 | A | 1/1988 | Haug | |
| 5,077,919 | A * | 1/1992 | Sinykin | 37/219 |
| 5,632,106 | A | 5/1997 | Sinykin | |
| 6,418,645 | B1 | 7/2002 | Hammerle et al. | |
| 2003/0051376 | A1 | 3/2003 | Lassonde et al. | |

FOREIGN PATENT DOCUMENTS

| | | | |
|---|---|---|---|
| DE | G 85 28 096.8 | U | 1/1986 |
| DE | 100 45 346 | A | 3/2001 |
| WO | WO 94/10392 | A | 5/1994 |

* cited by examiner

*Primary Examiner* — Robert Pezzuto
(74) *Attorney, Agent, or Firm* — Frommer Lawrence & Haug LLP; Ronald R. Santucci

(57) ABSTRACT

A ski slope snow tiller having a frame connected to a tractor movable in a travelling direction; a shaft crosswise to the travelling direction and fitted with tools for working the snow cover; a casing surrounding the shaft; a mat towed over the surface of the snow cover, behind the casing; and a guard located at least over the casing and the mat, to prevent snow accumulating.

14 Claims, 3 Drawing Sheets

SKI SLOPE SNOW TILLER

This application is a 371 of PCT/IB2008/000688 filed on Mar. 20, 2008, published on Sep. 25, 2008 under publication number WO 2008/114138 A which claims priority benefits of Italian Patent Application No. MI2007A 000565 filed Mar. 21, 2007, the disclosure of which is hereby incorporated by reference.

TECHNICAL FIELD

The present invention relates to a ski slope snow tiller.

BACKGROUND ART

A ski slope snow tiller normally comprises a frame connected to a tractor movable in a travelling direction; a shaft fitted with snow-working tools; a casing surrounding the shaft; and a mat towed over the snow surface, behind the casing.

Though highly effective in tilling snow on ski slopes, tillers of this sort have a tendency to accumulate, or at least fail to prevent accumulating, snow, which, be it produced by snowfall or thrown up by the tiller or the tractor to which the tiller is connected, deposits in particular on the part of the tiller between the casing the mat.

The amount of snow accumulated on the tiller depends on the width of the tiller, and, according to the Applicant's findings, may be as much as 600 kg. This added weight on the tiller has numerous drawbacks increased power consumption of the tractor; impaired maneuverability of the tractor and tiller as a whole; potential damage to the component parts of the tiller; increased wear of the tiller; and the necessity to clean the snow off the tiller before garaging the tractor and tiller, to prevent flooding the garage when the snow melts.

DISCLOSURE OF THE INVENTION

It is an object of the present invention to provide a tiller designed to eliminate as far as possible the drawbacks of the known art, while at the same time being cheap and easy to produce.

According to the present invention, there is provided a ski slope snow tiller, the tiller comprising a frame connected to a tractor movable in a travelling direction; a shaft fitted with tools for working the snow cover; a casing surrounding the shaft; and a mat towed over the surface of the snow cover, behind the casing; the tiller being characterized by comprising a guard located at least over the casing and the mat, to prevent snow accumulating.

In a first embodiment of the present invention, the tiller comprises a filler body made of relatively light material and located between the casing and the mat; the filler body having a top wall defining said guard.

In a second embodiment of the present invention, the tiller comprises a sheet over the casing and mat; the sheet defining said guard.

In a third embodiment of the present invention, the tiller comprises a filler body; and a sheet over the casing, the mat, and the filler body; the filler body serving to fill a tunnel formed between the casing, the mat, and the sheet, and to support at least a portion of the sheet.

BRIEF DESCRIPTION OF THE DRAWINGS

A number of non-limiting embodiments of the present invention will be described by way of example with reference to the accompanying drawings, in which.

BEST MODE FOR CARRYING OUT THE INVENTION

Figure 1:
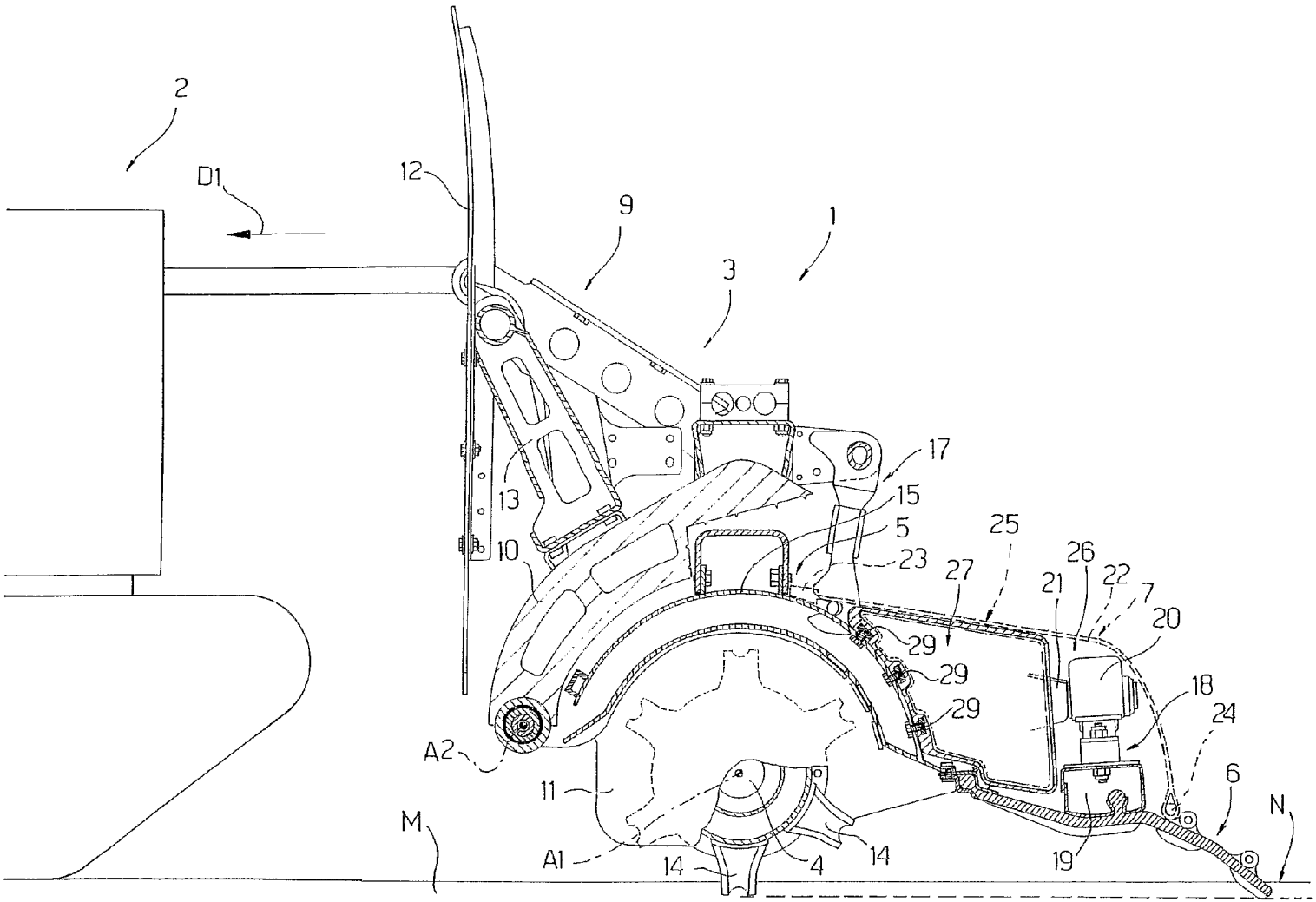
FIG. 1 shows a partly sectioned side view, with parts removed for clarity, of the tiller according to the present invention.

Number 1 in FIG. 1 indicates as a whole a tiller for tilling the snow cover M of ski slopes, and which is connectable to a tractor 2 defined, in the example shown, by a crawler vehicle for travelling over snow-covered slopes and for supporting and towing tiller 1 in a travelling direction D1.

Tiller 1 is designed to work a surface portion of snow cover M, and comprises a frame 3; a shaft 4 mounted to rotate with respect to frame 3 about an axis A1, and extending crosswise to travelling direction D1; a protective casing 5 enclosing shaft 4; a normally flexible mat 6 connected to casing 5 and towed over the surface N of snow cover M; and a guard 7 fitted over casing 5 and mat 6 to prevent slow accumulating between casing 5 and mat 6.

Figure 2:
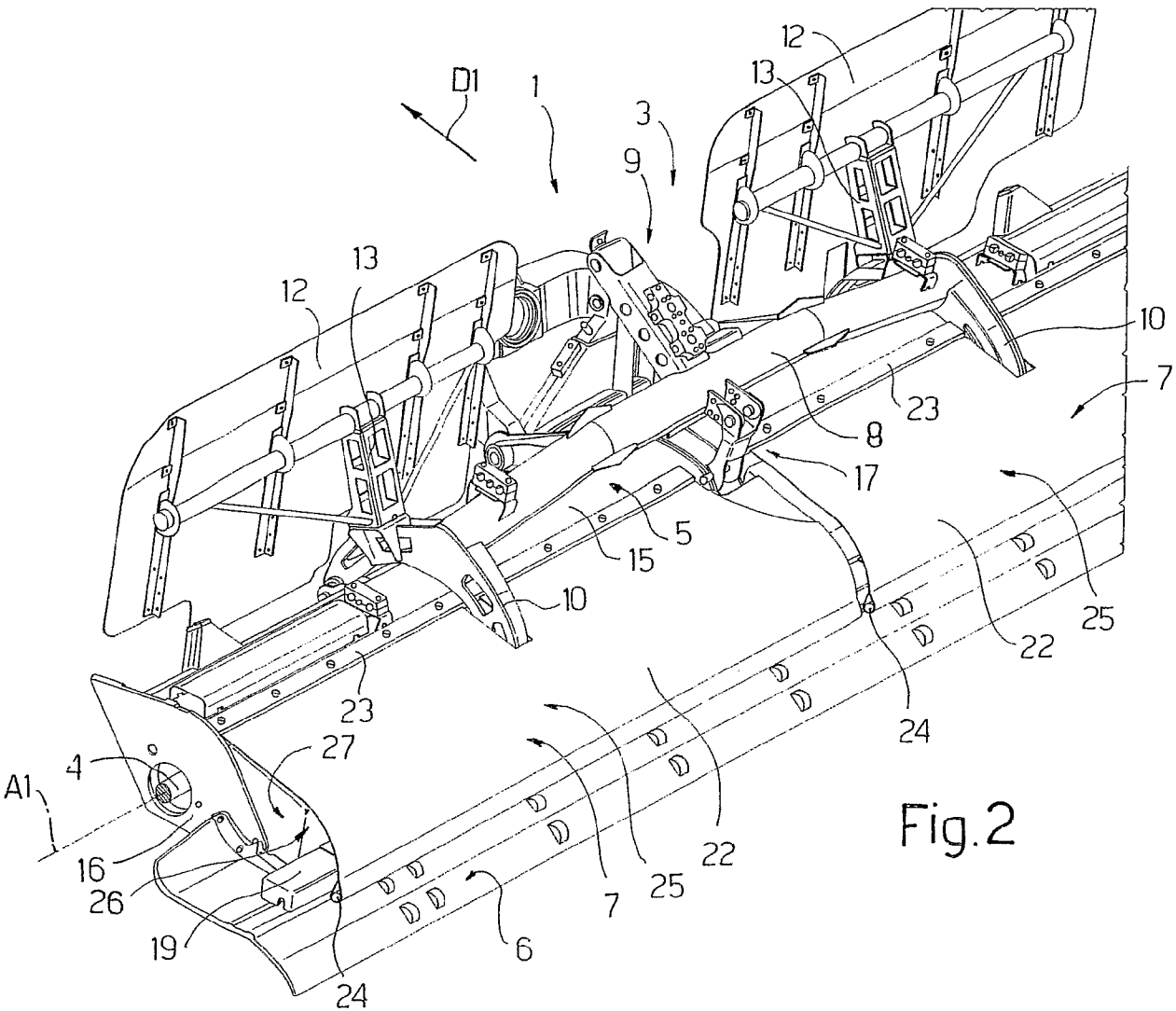
FIG. 2 shows a view in perspective, with parts removed for clarity, of the FIG. 1 tiller.

With reference to FIG. 2, frame 3 comprises a bar 8 substantially parallel to axis A1; a hitch device 9 fixed to bar 8 and for connecting tiller 1 to tractor 2; two arc-shaped segments 10 fixed to and crosswise to bar 8; and plates 11 (FIG. 1) for supporting shaft 4 by means of bearings not shown in the drawings.

Tiller 1 comprises two adjustable panels 12, which are fitted to respective arms 13 connected to segments 10, are positioned facing tractor 2 (FIG. 2), and serve to shield tiller 1 to a certain extent from snow thrown up by tractor 2.

With reference to FIG. 1, shaft 4 comprises a number of tools 14 equally spaced about and along axis A1, and each of which projects radially from shaft 4 and is designed to penetrate snow cover M.

Shaft 4 is rotated by an actuator—in the example shown, by a hydraulic motor (not shown) supplied with pressurized oil by tractor 2. The length of shaft 4 defines the working width of tiller 1 and the width of tiller 1 as a whole.

Casing 5 is substantially defined by a semicylindrical wall 15 extending roughly 180° about shaft 4 and along the whole length of shaft 4; and two lateral walls 16 fixed to semicylindrical wall 15. Casing 5 is fixed to frame 3 adjustably. In the example shown, casing 5 is fitted to frame 3 to rotate about an axis A2 parallel to axis A1, and is supported by a screw-nut screw device 17 connected to bar 8 and for adjusting the position of casing 5 with respect to shaft 4.

Figure 3:
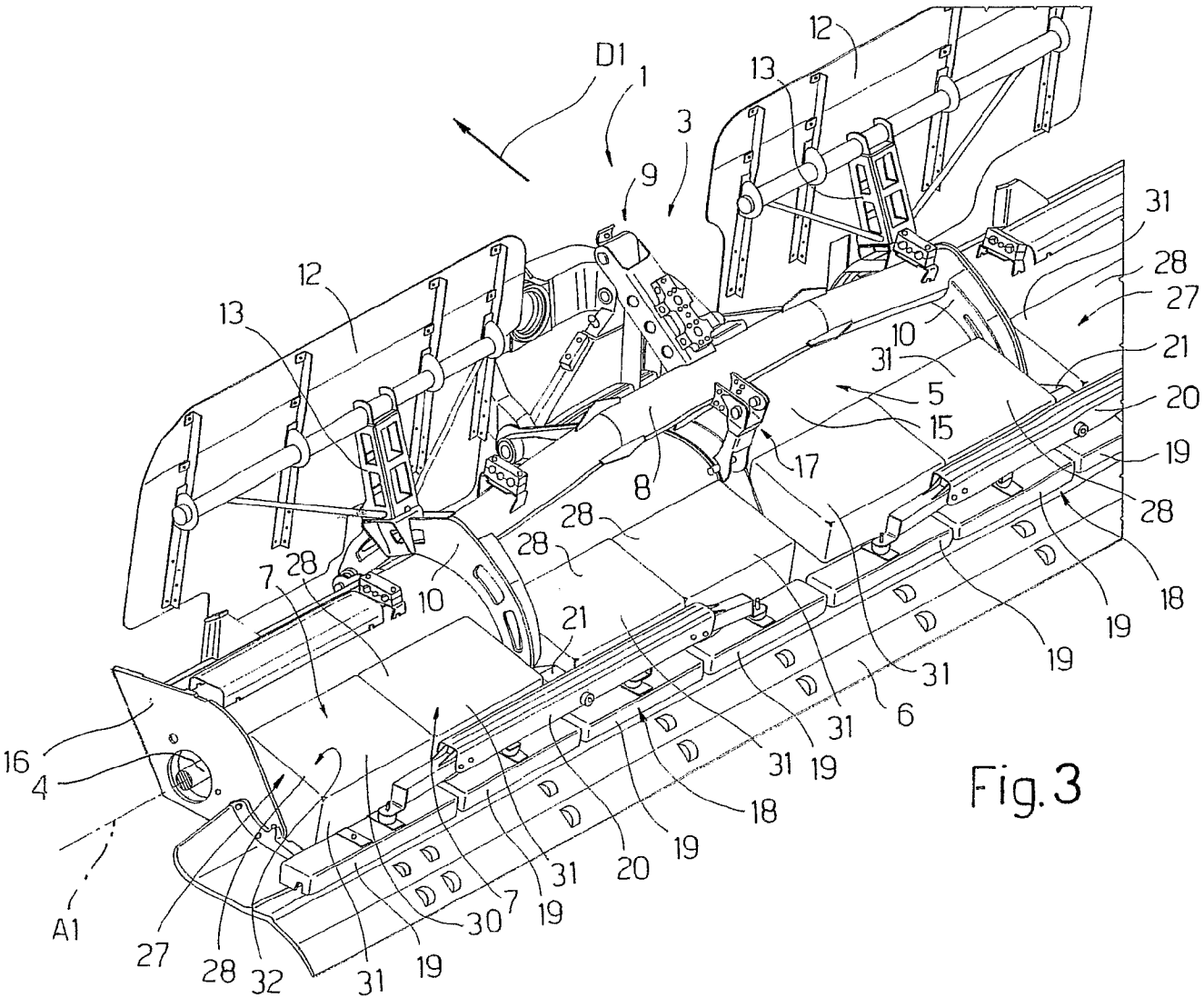
FIG. 3 shows a view in perspective, with parts removed for clarity, of a tiller in accordance with a variation of the present invention.

Mat 6 is wider than casing 5, is made of flexible material, and is fixed at one end to casing 5. As shown in FIG. 3, mat 6 is fitted to frame 3, which comprises two connecting devices 18, each connected to a respective segment 10 and to mat 6.

Each connecting device 18 provides for holding mat 6 on surface N of snow cover M, and comprises a number of pieces 19 parallel to axis A1, aligned with one another along axis A1, and connected to mat 6 along the top face of mat 6. Each piece 19 is connected to a top beam 20 parallel to axis A1, and is free to adjust its position with respect to beam 20, which is connected to a respective segment 10 by a respective arm 21.

With reference to FIG. 1, guard 7 is defined by a flexible sheet 22 having one end fixed to casing 5, and one end resting on mat 6. With reference to FIG. 2, guard 7 is defined by two side by side sheets 22, so that guard 7 extends the full width of casing 5. Each sheet 22 is fixed to casing 5 by a strip 23 screwed to casing 5, and the free end of each sheet 22 has a loop for insertion of a weigh-down bar 24.

Each sheet 22 is supported partly by frame 3—in the example shown, by one of beams 20—and is fixed to casing 5 higher up than beam 20, so that, between casing 5 and beam 20, sheet 22 slopes downwards to allow any snow deposited on sheet 22 to slide off. For this reason, sheet 22 has a shiny, slippery top surface 25. Behind beam 20, sheet 22 slopes down sharply, in the form of a roughly vertical portion.

Sheet 22, casing 5, and mat 6 form a tunnel 26, which may also be filled at least partly with snow. In accordance with a specific embodiment of the present invention, tunnel 26 is therefore substantially filled with a filler body 27 made of light material—meaning a material considerably lighter than snow—and which is complementary in shape to tunnel 26 so as to mate with casing 5 and mat 6, support and keep sheet 22 taut, and define the exact slope of sheet 22 between casing 5 and beam 20.

Combining lightweight filler body 27 with sheets 22 undoubtedly constitutes an excellent solution, though sheets 22 alone are quite capable of effectively preventing snow accumulation.

Filler body 27 is preferably hollow, and, in the example shown, is defined by a number of modular hollow bodies 28 arranged side by side along the width of tiller 1. Each hollow body 28 is made of thermoplastic material, in particular polyethylene, is preferably rotational-molded, and is fixed to casing 5 by means of screws, for which purpose, each hollow body 28 has a number of metal inserts 29.

In the FIG. 3 variation, sheets 22 are eliminated, and filler body 27 has a sloping top wall 30 which acts as guard 7.

Filler body 27 is preferably defined by a number of hollow bodies 28, each of which has a sloping top wall 31 forming part of wall 30, and has a surface 32 smooth and slippery enough to prevent snow from adhering.

As will be clear from the above description, the technical problem of snow accumulating on tiller 1 is solved in at least three ways:

sheets 22 covering casing 5 and mat 6, together with filler body 27 housed inside tunnel 26 formed by sheets 22;

sheets 22 covering casing 5 and mat 6, with no filler body 27 inside tunnel 26;

filler body 27 between the casing and mat 6, with no sheets 22.

Though the first solution is undoubtedly the most effective, the second and third have also proved highly effective in reducing snow accumulation, even in critical operating conditions.

The scope of the present invention also extends to solutions comprising one sheet or one one-piece filler body.

The invention claimed is:

1. A ski slope snow tiller for working in snow cover, the tiller comprising a frame connectable to a tractor and movable in a travelling direction;

a shaft fitted with tools for working the snow cover;

a casing surrounding the shaft;

a mat towed over the surface of the snow cover, behind the casing;

a guard located at least over the casing and the mat, to prevent snow accumulating; and a hollow filler body having a top wall defining said guard and comprising a plurality of hollow bodies, which are arranged side by side to define the filler body and are selective attachable to the casing.

2. A tiller as claimed in claim 1, wherein the guard has a surface sloping downwards in the opposite direction to the travelling direction so that snow slides off the guard.

3. A tiller as claimed in claim 2, wherein the guard surface is flat.

4. A tiller as claimed in claim 1, wherein the filler body is made of thermoplastic material.

5. A tiller as claimed in claim 4, wherein the filler body is made of polyethylene.

6. A tiller as claimed in claim 5, wherein the filler body is rotational-molded.

7. A tiller as claimed in claim 1, wherein the filler body is fixed to the casing.

8. A tiller as claimed in claim 7, wherein the filler body has metal inserts by which to fix the filler body to the casing by means of screws.

9. A tiller as claimed in claim 1, wherein said hollow bodies are identical.

10. A tiller as claimed claim 1, comprising a sheet over the casing and the mat; said sheet defining said guard.

11. A tiller as claimed in claim 10, wherein the sheet is fixed to the casing.

12. A tiller as claimed in claim 11, wherein the sheet is partly supported by the frame.

13. A tiller as claimed in claim 12, wherein the sheet has a free end weighted by a weigh-down bar.

14. A ski slope snow tiller for working a snow cover, the tiller comprising:

a frame connectable to a tractor and movable in a travelling direction;

a shaft fitted with tools for working the snow cover;

a casing surrounding the shaft;

a mat towed over the surface of the snow cover, behind the casing;

a hollow filler body made of relatively light material and located between the casing and the mat and comprising a plurality of hollow bodies, which are arranged side by side to define the filler body and are selectively attachable the casing; and a sheet over the casing, the mat, and the filler body, said filler body serving to fill a tunnel formed between the casing, the mat, and the sheet, and to support the sheet along at least a portion of the sheet.

* * * * *